US007568369B2

(12) United States Patent
Kubacki et al.

(10) Patent No.: US 7,568,369 B2
(45) Date of Patent: Aug. 4, 2009

(54) MOLD CONSTRUCTION FOR A PROCESS AND APPARATUS FOR MANUFACTURING SHAPED CONTAINERS

(75) Inventors: Edward F. Kubacki, Marengo, IL (US); John Czarnota, Plainfield, IL (US)

(73) Assignee: Ball Corporation, Broomfield, CO (US)

( * ) Notice: Subject to any disclaimer, the term of this patent is extended or adjusted under 35 U.S.C. 154(b) by 0 days.

(21) Appl. No.: 11/683,201

(22) Filed: Mar. 7, 2007

(65) Prior Publication Data

US 2008/0217823 A1 Sep. 11, 2008

(51) Int. Cl.
*B21D 26/02* (2006.01)

(52) U.S. Cl. ..... 72/62; 72/58; 72/61; 72/715; 425/525; 425/535

(58) Field of Classification Search ..... 425/308, 425/525, 809, DIG. 27, 522, 535, DIG. 231; 72/62, 367, 58, 59, 60, 61, 63, 367.1, 57, 72/715

See application file for complete search history.

(56) References Cited

U.S. PATENT DOCUMENTS 2,742,873 A 4/1956 Moore
3,335,590 A * 8/1967 Early ..... 72/58
3,461,699 A * 8/1969 Roth ..... 72/56
3,575,555 A * 4/1971 Schanne ..... 704/267
3,593,551 A * 7/1971 Roth et al. ..... 72/56
3,610,018 A 10/1971 Swanson et al.
3,688,535 A * 9/1972 Keinanen et al. ..... 72/56
3,698,337 A * 10/1972 Brawner et al. ..... 72/379.4
3,757,555 A 9/1973 Blutt et al.
3,797,294 A * 3/1974 Roth ..... 72/56
3,807,209 A * 4/1974 Aschberger et al. ..... 72/63
3,842,631 A * 10/1974 Aschberger et al. ..... 72/63
3,857,265 A * 12/1974 Howeler et al. ..... 72/56
3,896,648 A * 7/1975 Schertenleib ..... 72/61
5,187,962 A 2/1993 Bilko et al.

(Continued)

*Primary Examiner*—Steven P Griffin
*Assistant Examiner*—Seyed Masoud Malekzadeh
(74) *Attorney, Agent, or Firm*—Polster, Lieder, Woodruff & Lucchesi, L.C.

(57) ABSTRACT

A molding unit (20) for use in a can shaping process. Container preforms (F) are mounted on a table (16) which is rotated so a blank is moved from an initial loading station (P1) to a molding station (P4). The molding unit includes a two-part mold (20*a*, 20*b*) split vertically in half, and an inner surface (56) of each mold half is shaped to produce a desired can profile. Once the preform is in place, a pressurization unit (102) is lowered into place from above the mold onto an open, upper end of the preform. The mold is then closed and pressurized air is introduced into the preform and forces the sidewall of the preform outwardly against the inner surface of the mold to conform the preform into a desired container profile. The height of the preform tries to contract as its sidewall expands, but a force imparted to the preform by the pressurization unit controls the direction of any contraction so to prevent distortion of the container. After the shaping operation is complete, the pressurized air is withdrawn from the container, the mold is opened, and the pressurization unit is removed. The table is rotated to an off-loading station (P7) where the shaped container is removed from the table and conveyed to the next operating location. As the table moves the contoured container to the off-loading station, another container preform is loaded into the mold.

8 Claims, 8 Drawing Sheets

U.S. PATENT DOCUMENTS 5,261,261 A 11/1993 Ramsey
5,261,558 A 11/1993 Claydon
5,533,373 A 7/1996 Plester
5,622,070 A 4/1997 Bulso, Jr.
5,671,629 A * 9/1997 Valyi ..... 72/58
5,746,080 A 5/1998 Hartman et al.
5,776,270 A 7/1998 Biondich
5,794,474 A 8/1998 Willoughby et al.
5,829,290 A 11/1998 Harvey
5,899,104 A 5/1999 Brilman et al.
5,916,317 A 6/1999 Willoughby et al.
5,932,766 A 8/1999 Haight et al.
5,938,389 A 8/1999 Shore et al.
5,960,659 A 10/1999 Hartman et al.
5,970,767 A 10/1999 Hartman et al.
6,079,244 A 6/2000 Robinson et al.
6,151,939 A 11/2000 Hanna et al.
6,250,122 B1 6/2001 Robinson et al.
6,338,263 B1 1/2002 Obata et al.
6,343,496 B1 * 2/2002 Hanna et al. ..... 72/61
7,003,999 B2 2/2006 Campo et al.
7,004,000 B2 2/2006 Campo et al.
7,024,912 B2 4/2006 Campo et al.
7,107,804 B2 9/2006 Gong et al.
7,165,430 B2 1/2007 Weidmer
7,191,032 B2 3/2007 MacEwen et al.

* cited by examiner

MOLD CONSTRUCTION FOR A PROCESS AND APPARATUS FOR MANUFACTURING SHAPED CONTAINERS

CROSS REFERENCE TO RELATED APPLICATIONS

None

STATEMENT REGARDING FEDERALLY SPONSORED RESEARCH

Not Applicable.

BACKGROUND OF THE INVENTION

This invention relates to a process and apparatus for shaping metal containers such as aerosol containers; and more particularly, to a mold construction for use in the apparatus and with the process.

Aerosol containers or cans are used for a variety of personal grooming and household products including, among other things, products dispensed as a spray, a gel, or a foam. The containers have a main body section usually of a uniform diameter, cylindrical shape, with a dispensing valve assembly attached to the upper end of the body and a dome shaped end piece attached to the lower end of the body. However, it is known to form or shape the container so the profile of the container body has a non-uniform contour. Shaping cans is accomplished in different ways, one of which is to form the can body into a cylindrical shape, place the resulting blank or preform into a mold whose interior surface is formed into the desired final shape, and then inject a pressurized fluid into the can. The force created by the fluid pushes on the sidewall of the can body and forces it against the side of the mold, thereby conforming the can body shape to that of the mold.

In this regard, it is well-known to use compressed air as the pressurizing fluid. For example, U.S. Pat. No. 3,224,239, which issued in 1965, describes placement of a straight sidewall, cylindrical can body (17) into a mold (13). The mold has a cavity (20). A piston (10) is lowered into the container displacing the air in the container so as to compress the air. As a consequence, "The resultant air pressure within the can will be sufficient to cause a plastic flow of the can body 17 to conform with the cavity 20 of the mold 13." In co-pending, co-assigned U.S. patent application Ser. No. 10/946,593 there is described a dry hydraulic can shaping process in which a bladder is inserted into the can preform once it is in the mold. The bladder is then pressurized with air, or another fluid, which forces it against the sidewall of the can body and forces the sidewall to conform to a shape defined by the mold.

Over the years, a number of other patents have issued which describe various can shaping techniques in which air is the pressurizing fluid. For example, U.S. Pat. Nos. 2,742,873, 3,688,535, 5,187,962, 5,746,080, 5,829,290, 5,832,766, 5,938,389, 5,960,659, 5,970,767, and 6,026,670, describe methods and techniques for making shaped metal cans. In general, these patents describe placement of a preform container in a mold and then using a pressurized fluid to expand the sidewall of the container against the inner surface of the mold so to conform the shape of the container to the shape of the mold. Among the features described in some of these patents are a partial annealing process carried out at elevated temperatures (450°-500° F.) so to partially anneal the cans and increase their ductility, as well as place the preform in a mold which, when it closes, presses against at least a portion of the blank to precompress it before the pressurization process begins.

One issue with the making of shaped aerosol containers is process time and throughput. The present invention is directed to the manufacture of shaped metal cans using pressurized air as the pressurization medium, and in which the throughput of cans is substantially increased over known manufacturing methods.

BRIEF SUMMARY OF THE INVENTION

In accordance with the present invention, preformed can blanks are placed on a round table or carousel which is rotated either by use of a pulley mechanism, a gear arrangement, or a central motor drive. A number of alignment tools are uniformly spaced about the rim of the table to hold the preforms each of which has a cylindrical body section, a closed lower end, and an open upper end. As the table is rotated, the cans are sequentially moved (indexed) from one station to another with the preform being moved from an initial loading station, through an alignment station, to a molding station. The mold is a two-part mold split vertically in half, and the inner surface of the mold is shaped to produce a desired can profile. Once the container preform is positioned in the mold, a pressurization unit is lowered from above the mold onto an open, upper end of the preform and a nose portion of the unit is brought to bear against a the top of the preform. The mold sections are then brought together to close the mold. As the mold closes, portions of both the pressurization unit and alignment tool on which the preform is seated are locked in place and prevented from moving during the pressurization process.

A pressurized fluid, preferably air, is introduced into the preform and the air pressure forces the sidewall of the container outwardly against the inner surface of the mold to conform the container into the desired profile. The outward expansion of the container sidewall causes the height of the container to try to shrink in both directions with the result that the container tries to rise up from the bottom of the mold and simultaneously shrink down from the top of the mold. If this movement were unrestrained the shrinkage could be as much as 0.25" (63 cm). However, the contact between nose portion of the pressurization unit and the top of the container prevents the container from lifting off the alignment tool on which it is seated so any shrinkage is from the top of the container. Also during pressurization, double seams which are formed where lower and upper end pieces of the container are attached to a main body portion of the container, although unrestrained, do not significantly deform or distort because of the strength of the layers of material from which the seams are formed.

After the shaping operation is complete, the pressurized air is withdrawn from the container. The mold halves are moved apart from each other, opening the mold, and the pressurization unit is lifted from the top of the mold assembly. The shaped container is then moved to an off-loading station where the container is removed from the table and conveyed to the next operating location. As the table moves the shaped container to the off-loading station, another preformed container is moved into the mold assembly for shaping.

This manufacturing process has the advantage of reducing processing time and increasing the throughput of containers, while the use of air as the pressurized fluid eliminates secondary operations such as drying which are otherwise required when water or another hydraulic fluid is used for molding the container to a desired shape.

Other objects and features will be in part apparent and in part pointed out hereafter.

BRIEF DESCRIPTION OF THE SEVERAL VIEWS OF THE DRAWINGS

The objects of the invention are achieved as set forth in the illustrative embodiments shown in the drawings which form a part of the specification.

Corresponding reference characters indicate corresponding parts throughout the several views of the drawings.

DETAILED DESCRIPTION OF INVENTION

Figure 1:
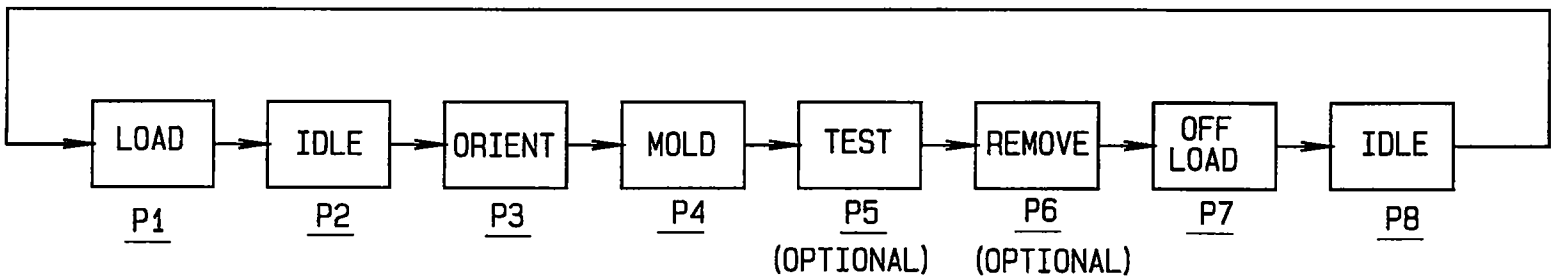
FIG. 1 is a flow chart of the shaping method of the present invention.

The following detailed description illustrates the invention by way of example and not by way of limitation. This description clearly enables one skilled in the art to make and use the invention, and describes several embodiments, adaptations, variations, alternatives and uses of the invention, including what is presently believed to be the best mode of carrying out the invention. Additionally, it is to be understood that the invention is not limited in its application to the details of construction and the arrangement of components set forth in the following description or illustrated in the drawings. The invention is capable of other embodiments and of being practiced or carried out in various ways. Also, it will be understood that the phraseology and terminology used herein is for the purpose of description and should not be regarded as limiting.

Figure 2A:
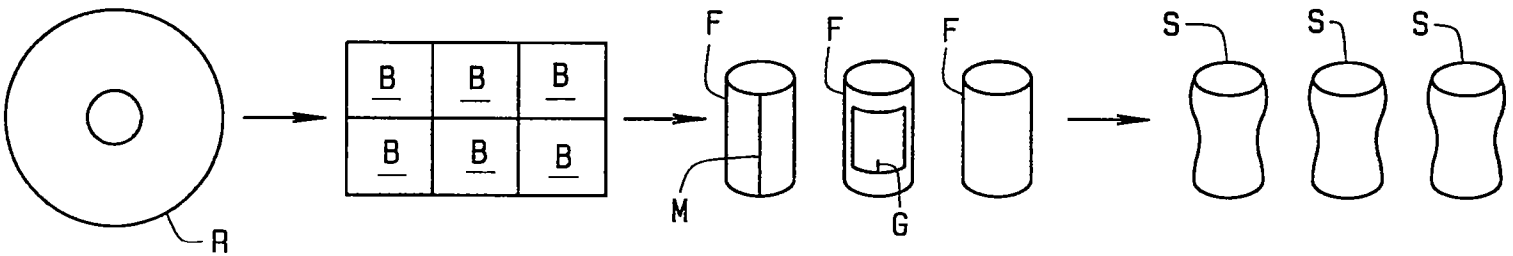
FIG. 2A is a simplified representation of the can shaping process, and FIG. 2B an elevation view of a container preform.
Figure 2B:
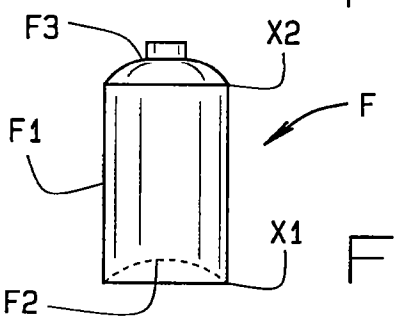

As shown in FIGS. 2A and 2B, a roll R of metal such as steel or aluminum is unrolled and cut into flat, rectangular can blanks B. These are each then further processed to create a preform F having a cylindrically shaped main body section F1. The can is a three-piece can with a dome shaped lower end piece F2 attached to the bottom of the can, and with a top piece F3, having a central opening therein for a valve to be attached to the container, attached to the top of the can. Both the lower and upper end pieces are secured to the preform using a "double seam" in which, for example, each seam comprises five (5) layers of metal. Lower end piece F2 is attached to main body section F1 by a double seam X1, and top piece F3 to section F1 by a double seam X2.

The preforms F are supplied to an apparatus 10 of the present invention where they are processed in accordance with the process of the invention to form shaped containers S. The formation of can blanks from a roll of steel or aluminum, and manufacture of the performs F, are well-known in the art and are not described.

Apparatus 10 first includes a conveyor 12 conveying preformed can blanks F from the location where they are formed to a shaping machine 13 of the apparatus. As the cans move along the conveyor in the direction indicated by the arrow in FIG. 3, they are captured by a pick-up unit 14, which is, for example, an electromagnetic unit. Pick-up unit 14, which initially is de-activated, is energized as a preform F reaches its location so to engage the can. Unit 14 then removes the can from conveyor 12 to a loading station P1 of an annular, ring shaped carousel 16 of apparatus 10. The preform is deposited on an alignment tool 18 which engages the preform, holds it in place on the carousel, and rotates the preform, as described hereinafter, to align the preform prior to its being shaped in a molding unit or mold 20. Alignment tool 18 can also use suction or a vacuum to engage the bottom of the preform and hold it in place on the alignment tool. Other pick-up, transfer, and holding devices known in the art can also be used without departing from the scope of the invention.

Figure 3:
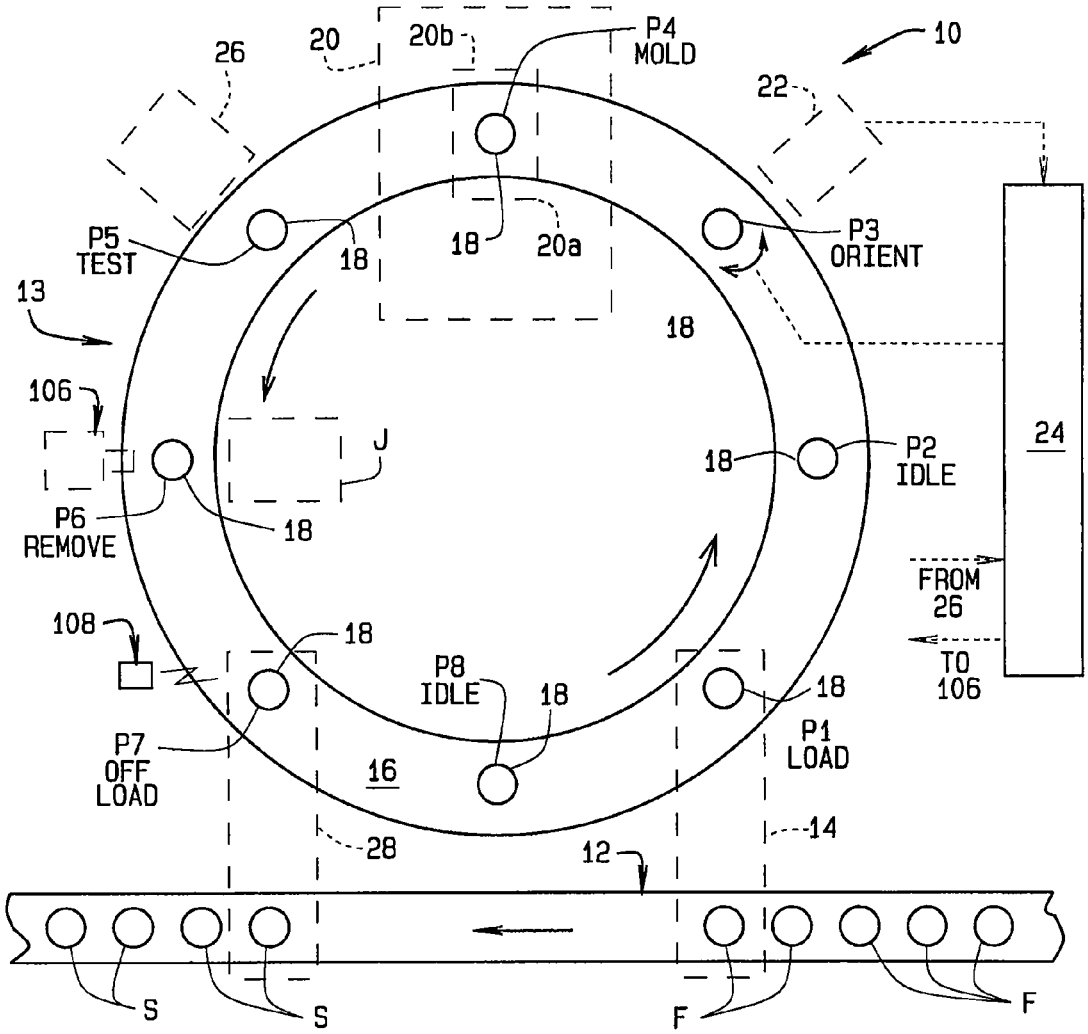
FIG. 3 is a plan view of the carousel of the apparatus illustrating the progression of containers through the shaping operation.

As shown in FIG. 3, carousel 16 has a series of alignment tools 18 (eight in all) equidistantly spaced around the carousel. The carousel sits horizontally and rotates in a counterclockwise direction as viewed from above in FIG. 3. The carousel is driven in one of a number of ways as described hereinafter.

In accordance with the method or process of the invention, as indicated in FIG. 1, a preform F is loaded onto the carousel at a station P1. The carousel is then rotated, or indexed, so to move the container from station P1 to an idle station P2. No operations are performed on the preform at this location.

Next, the carousel is rotated to move the preform to a station P3. Here, if necessary, the container is rotated to align or orient it with the molding unit 20 located at the next station P4. Two types of preforms are shaped using apparatus 10. One type is a plain container, and the other type is a container with graphic and/or textual material printed on its outer surface. In either instance, an orientation unit 22, in conjunction with a controller 24, operates to rotate alignment tool 18 until the preform is properly aligned before it is loaded into the molding unit.

After the container is properly oriented, the carousel is again indexed to move the preform to a station P4 and into molding unit 20 of the apparatus. Here the preform is formed or shaped in a manner to be described hereinafter into a shaped can S.

Once the shaping operation is complete, the carousel is indexed to move the shaped container to a station P5. Here, an optional pressure test may be performed by a pressurization test unit 26, again to be described in more detail hereafter, to determine if the shaped container can withstand the filling pressure to which it will subsequently be subjected when the can is filled with a product and a propellant for dispensing the product.

When the pressurization test is completed, the carousel is rotated to move container S to a station P6. Here, if the shaped container failed the test, it is ejected from the carousel and deposited in a reject container J. If the container passed the test, it is retained in place and the carousel is again rotated to move the shaped container to an off-loading station P7. At station P7, a pick-up unit 28, which is similar to unit 14, is energized as the shaped container reaches its location to engage the container. The pick-up unit then removes the shaped container from carousel 16 and transfers it back onto conveyor 12, or onto another conveyor. The container is now taken by the conveyor to a location where the next operation (further assembly, filling, packaging, storage, etc.) is performed. Meanwhile, the carousel is rotated though another idle station P8 and back to its initial location at P1.

It will be understood by those skilled in the art that the can shaping process is a continuous process with preforms being continuously deposited on carousel 16 from conveyor 12 and shaped containers being continuously removed from the carousel and deposited back onto conveyor 12 (or another conveyor). The process and apparatus enable a high throughput in the manufacturing process while insuring that properly shaped containers capable of withstanding the fill pressures to which they will be subjected are readily made.

In more detail, now, shaping machine 13, as shown in FIGS. 4-8, comprises a pair of legs 32 including legs 32*a*, 32*b*. The legs 32 extend upwardly from footpads 34 by which shaping machine 13 is mounted to a floor using bolts or other means of attachment (not shown). A pair of L-shaped cross members 36 extends between the legs at a height approximately midway the height of the machine. At least one brace 38 (see FIG. 4) extends between the cross members 36 to add stability to the machine. Another pair of cross members 40 extend between the legs at their upper end, also for increased stability, and strength. A generally rectangular platform 42 extends across the shaping machine, adjacent leg 32*a* where carousel 16 is also installed. The platform sits beneath the carousel and is attached to the top of cross members 36. The length and width of the platform is slightly less than the diameter of the carousel.

Figure 5:
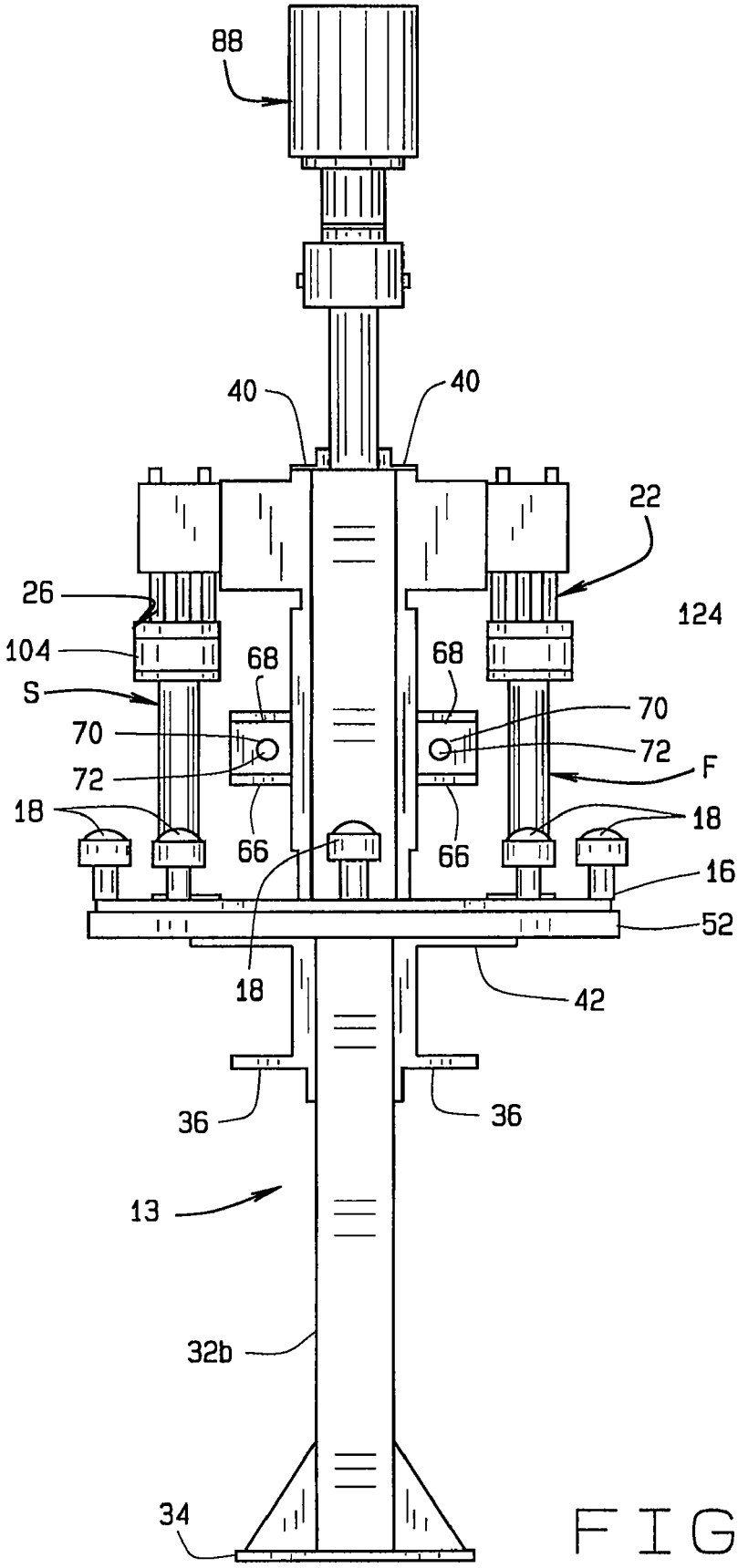
FIG. 5 is an end elevation view of this embodiment of the apparatus.

As previously noted, carousel 16 is ring shaped. The carousel is installed on the apparatus so that it encircles leg 32*a*. Therefore, when in operation, the carousel rotates about this leg. The carousel is supported by platform 42, and as seen in FIG. 5, the carousel sits adjacent the platform and revolves parallel to its upper surface. As previously noted, there are eight (8) alignment tools 18 affixed to the top surface of carousel 16, these alignment tools being equidistantly spaced 450 apart around the top of the ring. Also as noted previously, the alignment tools use either a magnetic, a vacuum, or a suction force to pick up and hold a preform on the carousel as it rotates.

Figure 4:
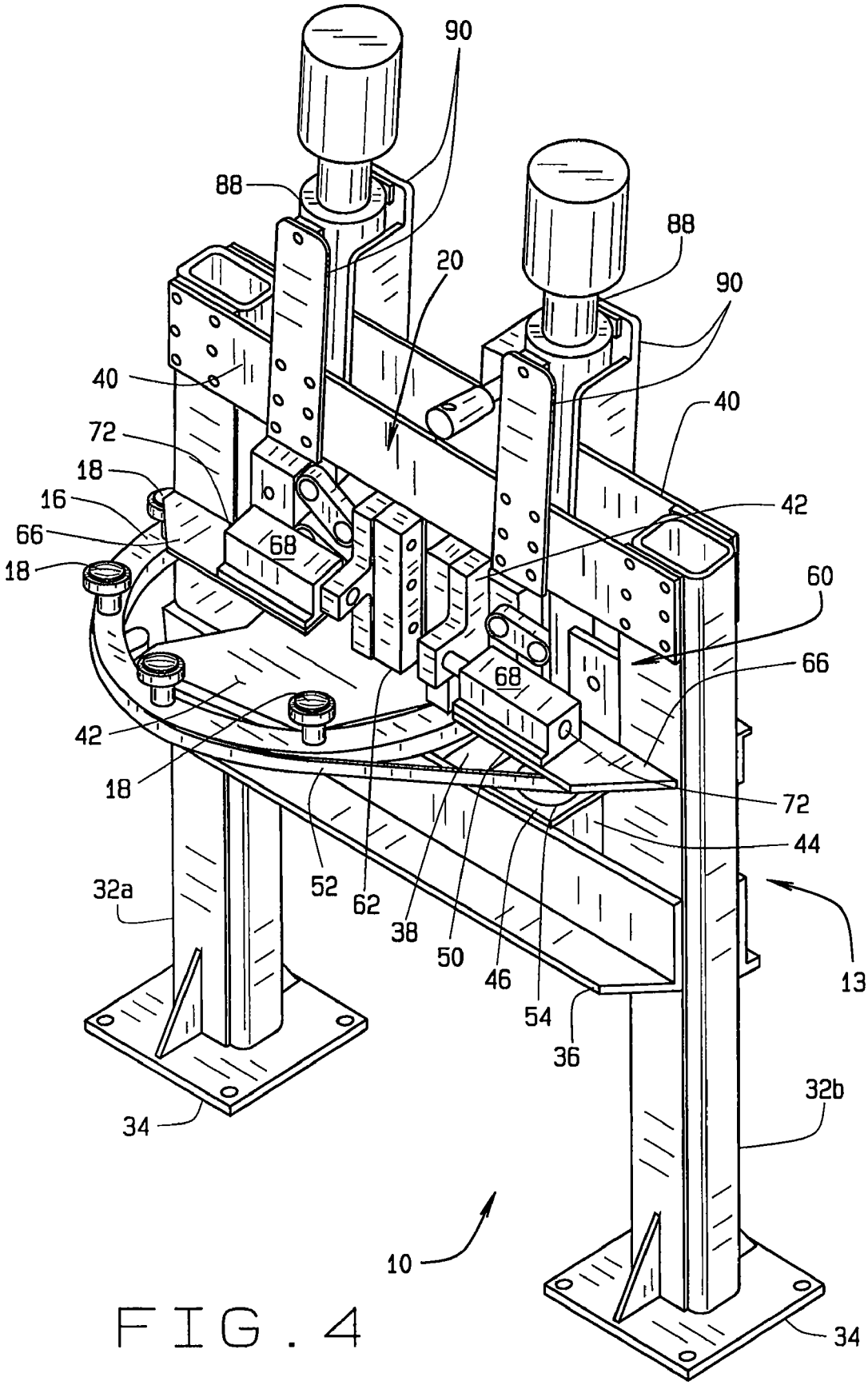
FIG. 4 is a perspective view of one embodiment of the apparatus.
Figure 6:
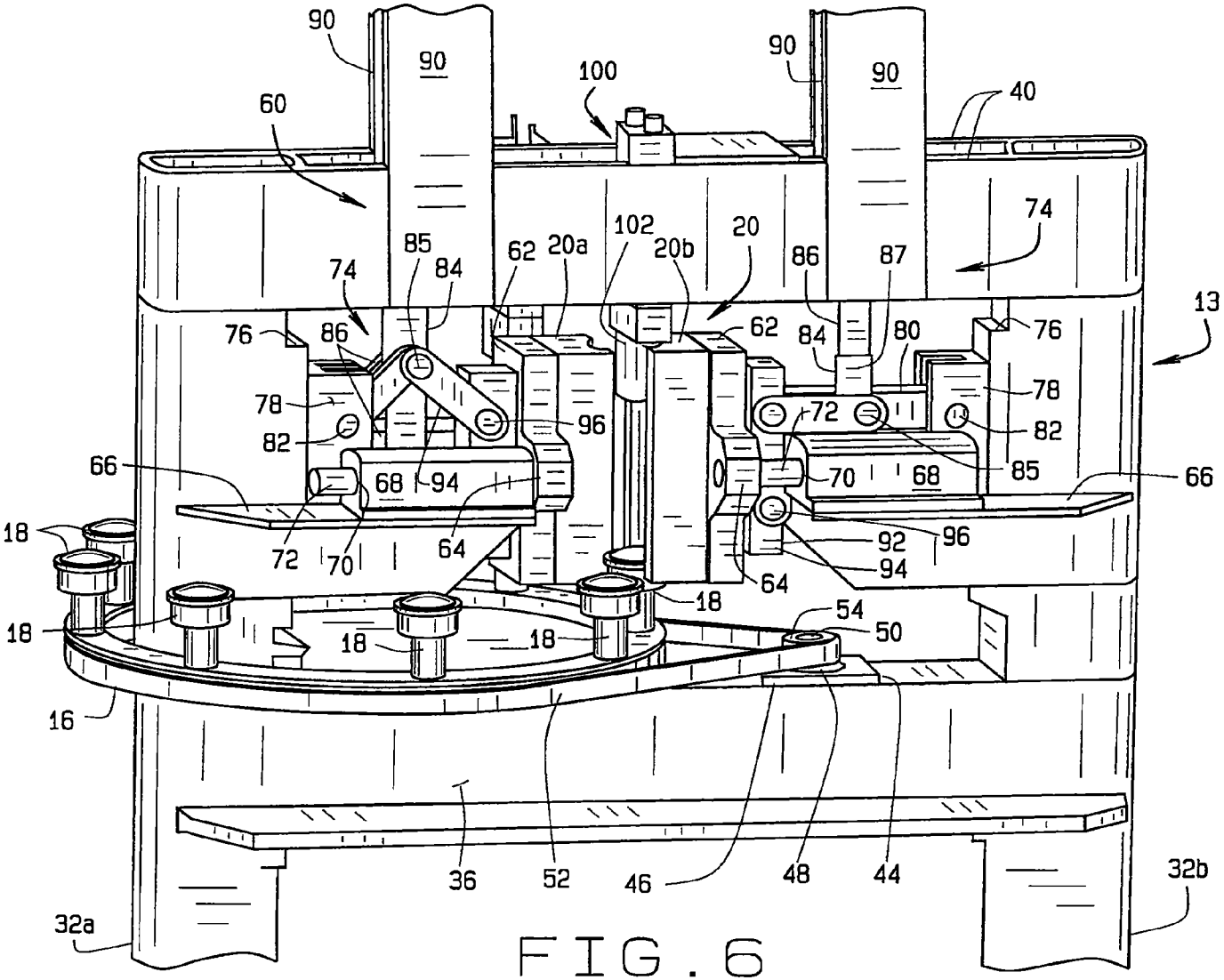
FIG. 6 is a partial side elevation view of this embodiment of the apparatus.

Carousel 16 is rotatably driven by a motor 44 (see FIGS. 4 and 6). The motor is mounted to a plate 46 which fits between support members 36. The plate has a central opening 48 for mounting the motor between the support members. The motor is installed so that it sits vertically between the support members with a motor shaft 50 extending upwardly through the upper end of the motor. A belt 52 fits around the perimeter of carousel 16 and around a pulley or hub 54 (see FIG. 6) attached to the outer end of the motor shaft. Operation of motor 44 is also controlled by controller 24 which controls starting and stopping of the motor, dwell time of carousel 16 at each of the stations P1-P8, and the speed at which the carousel moves between stations. The controller is programmable to vary the speed at which the motor operates and consequently the throughput of apparatus 10. The speed of motor 44 operation is a function, for example, of the time of a molding operation, and the time it takes to first align the preform before it is molded, and the subsequent testing of a shaped container S to determine if the shaped container meets the standards for pressurization.

Figure 7B:
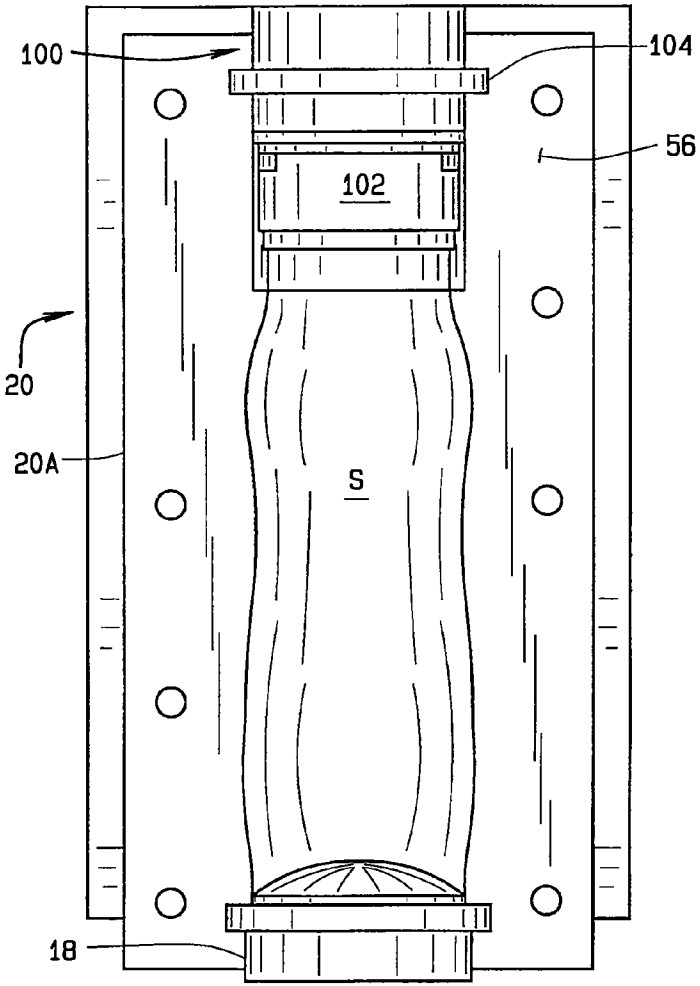
FIG. 7B is a view similar to FIG. 7A after the molding operation is complete and a shaped container has been formed.
Figure 7A:
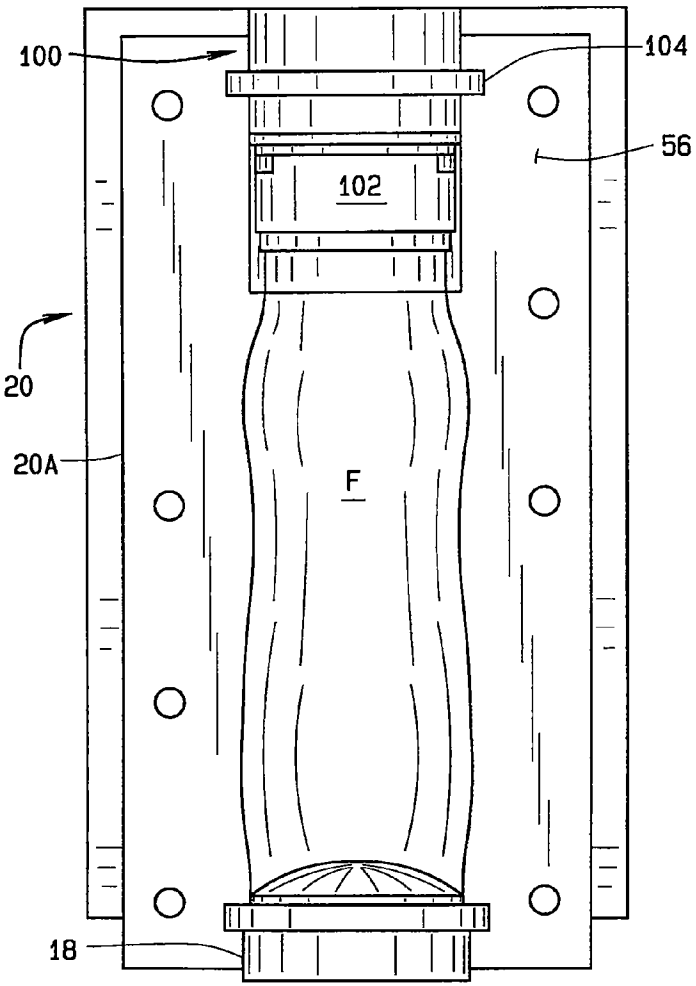
FIG. 7A is an elevation view of one-half of the mold used with the apparatus and including a pressurization unit lowered onto the top of a preform for shaping the container.

Molding unit 20 comprises a two-part mold consisting of mold sections 20*a*, 20*b*. As shown in the drawings, mold 20 is split vertically in half so that each mold section is initially horizontally separated; but when a preform is moved into place at station P4, the sections are moved together and close about the preform. As shown in FIG. 7A, an inner surface 56 of mold section 20*a* is shaped to a desired can profile. Although not shown in the drawings, the inner surface of mold section 20*b* is similarly profiled.

As noted, once a container preform F is in place the mold sections are brought together. This is accomplished by a toggle mechanism indicated generally at 60 which is also operated by controller 24. In FIGS. 4 and 6, each mold section 20*a*, 20*b* is shown mounted to a backing plate 62. An ear 64 extends horizontally outwardly from each side of each backing plate. An L-shaped bracket 66 is attached to each side of each leg 32*a*, 32*b*, and extends inwardly toward molding unit 20. A guide 68 is mounted on the top surface of each bracket adjacent the outer end of the respective backing plates. Each guide has a central opening 70 extending longitudinally of the guide, and a rod 72 is installed in this opening and is reciprocally movable through it. The ears 64 on the backing plates 62 each have openings which are aligned with the openings in the guides 68. The length of the rods 72 is greater than the length of the guides 68 for the ends of the rods to project through the openings in the ears 64 so to guide horizontal movement of the respective mold sections 20*a*, 20*b* as molding unit 20 is opened and closed.

Figure 8:
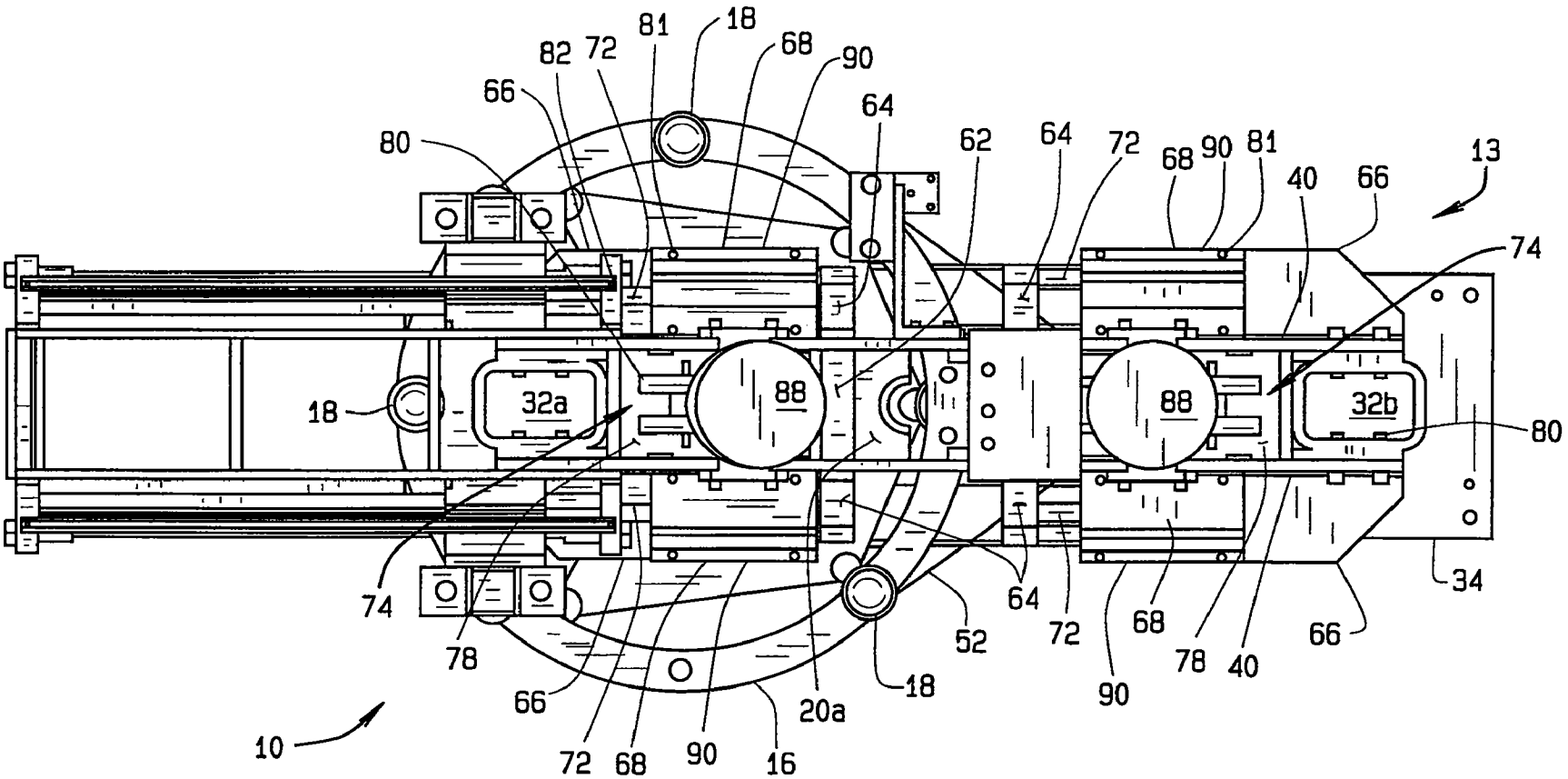
FIG. 8 is a top plan view of the apparatus.

Next, mechanism 60 includes a pair of toggle units 74 one of which is connected to backing plate 62 of each mold section. A plate 76 is attached to the inner face of each leg 32*a*, 32*b*. A generally W-shaped (when viewed in plan as shown in FIG. 8) bracket 78 is mounted to each plate 76 with the open end of each bracket facing outwardly. Connected to each bracket 78 is a lever arm 80. The lever arms are H-shaped (when viewed in plan as again shown in FIG. 8). The legs forming the outer end of each lever arm 80 straddle a center extension 81 of each bracket 78, and this end of each lever arm is rotatably secured to the bracket by a pin 82 which extends transversely of the bracket. The other end of each lever arm 80 straddles a vertically extending plate 84 and is secured to the plate by a pin 85. As shown in FIG. 6, a pair of lever arms 80 are rotatably connected between bracket 78 and plate 84, one lever arm 80 being an upper lever arm connected to the plate, and the other lever arm being a lower lever arm connected thereto.

An upper end of each plate 84 is attached to the bottom of a post 86 by a pin 87. The posts extend downwardly from respective toggle drive units 88 which are mounted atop shaping machine 13. The drive units are mounted to respective brackets 90 which are attached to the outer face of the upper support members 40 of the shaping machine with the drive units being fitted between the members.

Attached to backing plate 62 of each mold section 20*a*, 20*b* is a bracket 92. A pair of lever arms 94 each have an outer end which is commonly, rotatably connected to plate 84 with the same pin 85 with which the outer ends of each lever arm 80 are attached to the plate. The other end of the lever arms 94 are rotatably connected to the brackets 92 by pins 96. As with the lever arms 80, there are two pair of lever arms 94 rotatably connected between each plate 84 and its adjacent bracket 92. One pair of lever arms 94 is attached between the upper end of plate 84 and a bracket 92, with the other pair of lever arms being attached between the lower end of the plate and the lower end of its associated bracket.

In operation, mold unit 20 is open when a preform F is moved from alignment station P3 to molding station P4. After the preform is located within the mold, an air pressurization unit 100 of molding unit 20 is activated by controller 24 to lower a pressurization cap 102 into place onto the upper, open end of the preform. Unit 100 is installed between the upper support members 40 and pressurization cap 102 is aligned with the mold sections 20*a*, 20*b* so to fit in an opening in the tops of the molding sections once they are closed together. When cap 102 is in place, controller 24 activates drive units 88 to lower the respective plates 84 controlled by the drive units. The lowering motion causes the lever arms 80 and 94 attached to the plates 84 to straighten out. This action moves the mold sections 20*a*, 20*b*, together, closing the mold sections about the preform.

Figure 9:
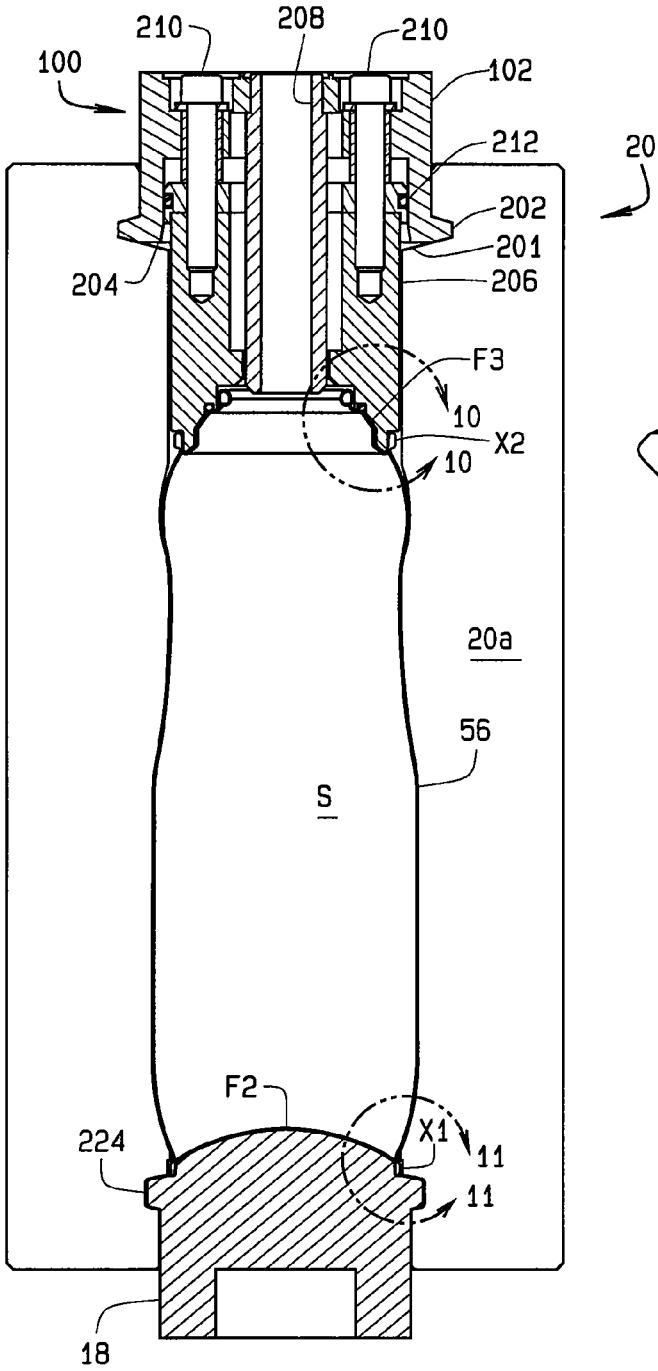
FIG. 9 is a detailed elevation view of one mold section.

Referring to FIG. 9, mold section 20*a* of molding unit 20 is shown in more detail. While the following discussion is with respect to mold section 20*a*, it will be understood that mold section 20*b* is similarly constructed. Mold section 20*a* has an annular groove 202 in which a lower flange end 204 of cap 102 is received. When the mold is closed, flange 204 is captured in the groove and cap 102 is prevented from moving until the mold sections are again separated at the completion of a molding operation. The pressurization unit further has a head 206 including a tube 208 through which the pressurized fluid is introduced into the preform. Head 206 is attached to cap 102 by bolts 210. An O-ring 212 seals between the head and the cap.

Figure 10:
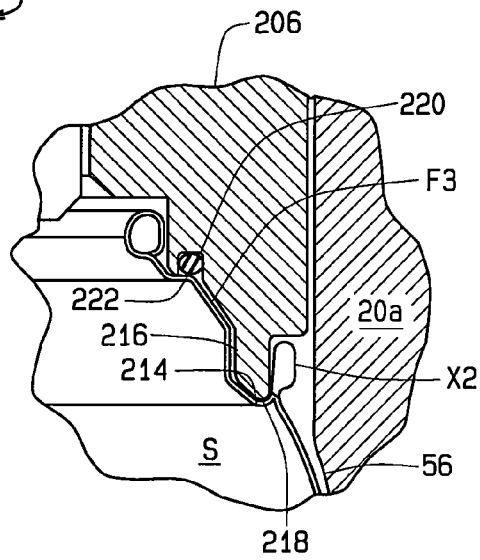
FIGS. 10 and 11 are partial elevation views of the mold taken along lines 10-10 and 11-11 in FIG. 9.

Top piece F3 of container S is, as noted, secured to the main body portion of the container by the double seam X2. As shown in FIG. 10, when the top piece of the container is attached to the main body portion, an annular channel 214 is formed immediately inwardly of the double seam X2. The lower end of head 206 has a central opening whose sidewall is profiled to conform to the shape of top piece F3 for this end of the head to fit over the top piece of the container when pressurization unit 100 is lowered into place. A circumferential ring or nose 216 fits into the channel with the tip end 218 of the nose bearing against the bottom of the channel. Nose 216 orients or aligns the container preform in molding unit 20, with the tip end of the nose maintaining contact with the preform during pressurization of the container so to maintain a constant downward force on the preform which, together with the internal shaping pressure exerted on the inside bottom surface of the container, urges the lower end of the preform against alignment tool 18. As is seen in FIG. 10, no contact is made between either sidewall 56 of the mold sections 20*a*, 20*b* and seam X2, nor between nose 216 and the seam. A groove 220 is formed in head 206 adjacent an upper shoulder of top piece F3. An O-ring 222 is received in this groove and seals off the outside of the container from the air pressure inside the container when shaping occurs. There is no pressure seal formed between the mold, when it is closed, and the atmosphere. Accordingly, there is no equalization of the pressure inside the container and that outside the container during shaping.

Figure 11:
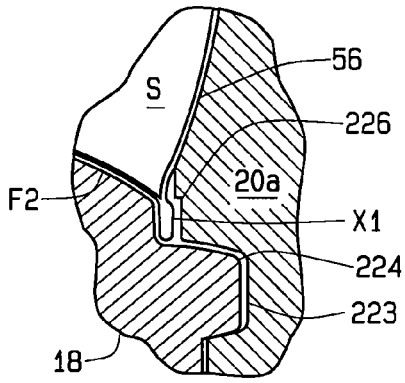

Referring to FIG. 11, mold section 20*a* has an annular groove 223 in which a flange 224 of alignment tool 18 is received. When the mold is closed, flange 224 is captured in the groove and the alignment tool is prevented from moving until the mold sections are again separated at the completion of the molding operation. The upper end of alignment tool 18 is contoured to conform to the dome shaped portion of bottom piece F2 of the container. The double seam X1 formed between bottom piece F2 and the main body of the container overhangs the side of the upper end of alignment tool 18 and is spaced from the side of the holder. Sidewall 56 of mold section 20*a* has an inwardly extending recess 226 formed adjacent seam X1. The recess is a stepped recess and provides a space between the seam and sidewall of the mold. The recess extends above the height of the seam for the sidewall of the mold section to not be in contact with the seam when the mold is closed. Although the bottom of seam X1 is shown in FIG. 11 as not being in contact with the upper surface of flange 224, the bottom of this seam may contact, but not rest upon or be supported by, the flange.

Once the two sections of the mold unit are brought together, a pressurized fluid, preferably air, is now introduced into the preform through tube 208. The air pressure forces the sidewall of preform F outwardly against inner surface 56 of the mold sections to conform the preform to the desired container S profile as shown in FIG. 7B. The outward expansion of the container sidewall also causes the container to try to shrink, in both directions. That is, the height of the container wants to contract, with the result that the container tries to rise up from the bottom of the mold and simultaneously shrink down from the top of the mold. If unrestrained, this movement could be approximately 0.25" (63 cm). However, during the shaping process, the contact between nose head 216 of the pressurization unit and channel 214 of top piece F3 of the container, together with the internal pressure exerted against the inside surface of the bottom piece of the container, prevents the bottom of the container from lifting off alignment tool 18. As a result, any movement of the container is downward from the top of the container. Also, during pressurization, double seams X1 and X2, although unrestrained, do not significantly deform or distort because of the strength of the layers of material from which the seams are formed.

After the shaping operation is completed, controller 24 again activates drive units 88. This time, operation of the drive units is to lift the respective plates 84. The lifting motion causes lever arms 80 and 94 to contract toward each other and this action draws mold sections 20*a*, 20*b* away from each other, opening the mold. With the mold open, controller 24 operates pressurization unit 100 to raise cap 102 off shaped container S so the container can be moved to station P5.

At station P3, prior to the molding operation, preform F is rotated, as necessary, so that when it is inserted into the mold at station P4, it is properly aligned with the mold. As noted previously, the container shaped in the mold will either be a plain container, or the container will have graphic and/or textual material G printed on its outer surface. Any printing that is done to the container is applied to the container while a blank, and before the blank is shaped into a preform.

Alignment of preform F is performed by orientation unit 22 installed at station P3. If shaped container S has a blank outer surface, then when the preform reaches the station, it passes under a magnetic head 104 of unit 22. The magnetic head generates a magnetic field around the preform and an eddy current is produced by the field at the location of the seam M which is created when preform F is produced from blank B. Orientation unit 22 includes an eddy current sensor (not shown) which senses the location of the field generated at seam M. This location information is then compared with alignment information stored in controller 24 as to the desired location of seam M when the preform is inserted into molding unit 20. If the seam location corresponds to the stored location information, controller 24 activates motor 44 to move the carousel from station P3 to station P4. If, however, the seam location is not at the desired location, controller 24 activates alignment tool 18 on which the preform is held to rotate the preform, in either the clockwise or counterclockwise direction, until the location of seam M is at the desired location. When that point is reached, controller 24 stops rotation of the alignment tool and activates carousel 16 to move the preform to station P4 for molding.

Again as previously noted, if preform F has material printed on its exterior surface, an alignment guide G (see FIG. 2) is included in the printed material. Now, orientation unit 22 is located beside carousel 16, as shown in FIG. 3, rather than above the carousel as shown in FIG. 5. In its position shown in FIG. 3, the orientation unit includes an optical scanner for locating the position of the guide. This is accomplished by controller 24 first comparing the results of an optical scan with information stored in the controller as to the desired location of guide G. As before, if the guide location corresponds to the stored location information, controller 24 activates motor 44 to move the carousel from station P3 to station P4. However, if the guide is not at the desired location, the controller then commands rotation of alignment tool 18 in either direction, as indicated by the two-headed arrow in FIG. 3, until the guide mark is at the desired location. When that point is reached, controller 24 stops rotation of the alignment tool and activates carousel 16 to move the preform to station P4 for molding.

As further previously referred to, after a shaping operation is complete, carousel 16 is rotated to move a shaped container S to station P5 where a pressure test is optionally performed by pressurization test unit 26. The test is performed to insure the shaped container can withstand the filling pressure to which it will subsequently be subjected when filled with a product to be dispensed and the propellant used to dispense the product. Because the container was pressurized during shaping, a potential leak may have developed in the can if, for example, the seam M formed when preform F was made is overly stressed. In such circumstance, there is the possibility the seam will burst. Alternately, if a slow leak develops, by the time the container is in the hands of the ultimate consumer, the can may be unable to dispense product. The resultant "dead" container results in customer unhappiness and warranty issues.

As shown in FIG. 5, test unit 26 includes a chuck or seal 104 which is lowered onto the upper, open end of container S when the carousel stops at location P5. When the container is sealed, a predetermined amount of pressurized air is injected into the container to raise the pressure in the container to a predetermined level which is a function of the pressure level within the container when it is filled with a product to be dispensed from the container and a propellant used to dispense the product. This pressurized air is delivered from the separate source (not shown) from that used to pressurize the preform F in mold unit 20. After pressurization, the air pressure level within the container is monitored by a pressure sensor (not shown) whose output is supplied to controller 24. If there is substantially no air leakage out of the container over a predetermined time interval (e.g., 3 seconds), the container is considered to have passed the test and is deemed acceptable for filling. If, however, the air pressure level within container S falls below a predetermined level during the test interval, this is indicative that the container leaks and should not be subsequently used.

When the pressure test is completed, chuck 104 is removed from the top of container S and carousel 16 is indexed from position P5 to position P6. An air pressure unit 106 is located at station P6 and is operable by controller 24. If the container failed the pressure test at station P5, then when the container reaches station P6, controller 24 activates unit 106 to emit a blast of air sufficient to knock the container off its alignment tool 18 and into reject container J. However, if the container passed the pressurization test, then unit 106 is not activated and the container is retained on its alignment tool.

Finally, carousel 16 is moved to station P7. When the container reaches this station, A sensor 108 determines whether or not a container S is on alignment tool 18. If it is, an indication is provided controller 24 which activates pick-up unit 28 to off-load the container from the carousel and convey it to conveyor 12 (or some other conveyor) which will take it to its next destination. If the sensor senses that there is no container on the holder, controller 24 does not energize unit 28. Rather, after the appropriate dwell period, the carousel is rotated from station P7 to station P8, and from there back to station P1 to repeat the process.

It will be appreciated that the throughput of apparatus 10 is primarily a function of three operations which are conducted during each revolution of carousel 12. The first is the amount of time required to orient or align a preform F before it is conveyed into mold unit 20. Second is the actual time required to lower pressurization cap 102 into place onto the upper, open end of the preform, close mold halves 20*a*, 20*b* about the preform, pressurize the preform to shape it into the container, open the mold sections, and remove cap 102. Third is the time required for the pressurization test. Overall, the amount of time required to execute one cycle of the shaping process is approximately six (6) seconds, which converts to a throughput of shaped containers of approximately six hundred (600) per hour.

The advantages of apparatus 10 are that it can achieve a relatively high throughput of containers with a very low reject rate. Also, because compressed air is the preferred pressurization fluid, secondary operations such as washing and drying the containers are eliminated. Third, apparatus 10 is compact and requires a relatively small footprint in a manufacturing area and it can be readily fitted into a production line.

In view of the above, it will be seen that the several objects and advantages of the present invention have been achieved and other advantageous results have been obtained.

Having thus described the invention, what is claimed and desired to be secured by Letters Patent is:

1. A molding unit for shaping a container preform into a shaped container having a predetermined sidewall contour, the preform being supported on a tool which moves the preform into and out of the molding unit and supports the preform in the molding unit during a shaping process, the molding unit comprising:

a two-part mold split vertically in half providing two mold sections with inner surfaces of the respective mold sections shaped to produce a specific container contour matching the shape of the inner surfaces;

a pressurization unit positioned over an open end of the preform prior to closing the mold, a pressurized fluid being introduced into the preform through the pressurization unit after the mold is closed to force a sidewall of the preform outwardly against the inner surfaces of the mold sections to shape the preform to the specific container contour, a height of the preform contracting as a sidewall expands, the preform having a main body portion and a top piece attached thereto by a double seam, the pressurization unit including:

a head comprising:

a central opening whose sidewall is profiled to conform to the shape of the top piece for the head to fit over the top piece when the pressurization unit is lowered into place; and a circumferential nose fitting into a bottom surface of an annular channel of the top piece with a tip end of the nose bearing against the bottom surface of the channel, the head structured and operable to move downward as the preform contracts such that the nose exerts a downward force on the top piece as the height of the preform contracts, thereby controlling the direction of contraction and preventing distortion of the container; and a cap with an annular flange received within annular groove formed in an upper end of the mold sections to prevent movement of the cap when the mold is closed and until the mold sections are again separated at the completion of a molding operation, each mold section inner surface structured to provide space between each mold section and the top double seam such that the top double seam is not contacted by the mold sections or the nose of the pressurization unit head so to be unsupported by the mold and free to move during the shaping process, and the container preform having a lower end seated on the tool with the downward force imparted by the pressurization unit head on the preform preventing the lower end from lifting off the tool so that the height contraction of the preform occurs only from the upper end of the preform.

2. A molding unit for shaping a container preform into a shaped container having a predetermined sidewall contour, the preform being supported on a tool which moves the preform into and out of the molding unit and supports the preform in the molding unit during a shaping process, the preform including a hollow central body portion, a top piece with a central opening therein, and a bottom piece closing the bottom of the preform, the top and bottom pieces each being attached to respective ends of the central body portion by a double seam, the molding unit comprising:

a two-part mold split vertically in half providing two mold sections with inner surfaces of the respective mold sections shaped to produce a specific container contour matching the shape of the inner surfaces, the mold having a first groove at an upper end of the mold and a second groove at the lower end of the mold;

a pressurization unit positioned over the upper end of the preform prior to closing the mold for a pressurized fluid to be introduced into the preform through the pressurization unit after the mold is closed to force a sidewall of the preform outwardly against the inner surfaces of the mold sections to shape the preform to the desired container contour, the pressurization unit including a cap having a flange received in the first mold groove to prevent movement of the cap when the mold is closed and further including a head having a central opening whose sidewall is profiled to conform to the shape of the preform to piece to over the top piece of the preform and having a nose received in a channel formed about an outer margin of the top piece, the head structured and operable to move downward as the sidewall of the preform is forced against the inner surfaces of the mold sections by the pressurized fluid such that a tip end of the nose bears against the bottom of the channel and exerts a downward force on the preform during pressurization, each mold section inner surface structured to provide space between each mold section and the double seam by which the top piece is attached to the central body portion of the preform such that the double seam by which the top piece is attached to the central body portion of the preform is not contacted by either of the mold sections or the pressurization unit when the mold is closed so to be unsupported thereby and free to move during the shaping process; and, the bottom piece of the preform being seated on the tool which has a flange received in the second mold groove to prevent movement of the tool when the mold is closed, the tool structured such that the double seam by which the bottom piece is attached to the central body portion of the preform overhangs an upper end of the tool and extends away from a side of the tool when the mold is closed so to not be in contact with the tool and thereby be unsupported and free to move during the shaping process, whereby, during a molding operation, the downward force imparted by the pressurization unit head on the preform prevents the lower end of the preform from lifting off the tool so that any shrinkage in height of the container occurs only from the upper end of the container and the respective double seams are unrestrained and free to move.

3. The molding unit of claim 2 in which the inner surfaces of the mold sections above the second groove have inwardly extending lower stepped recesses formed adjacent the double seam connecting the bottom piece to the central body portion of the preform the lower recesses structured to provide space between each mold section and the double seam connecting the bottom piece to the central body portion of the preform such that the double seam connecting the bottom piece to the central body portion of the preform will not contact the mold during the shaping process.

4. The molding unit of claim 3 in which the lower recesses are each a stepped recess that provides a space between each respective double seam and the inner surfaces of the mold sections, each recess extending above the height of each respective double seam such that the inner surfaces of the mold sections do not contact the respective double seam when the mold is closed.

5. The molding unit of claim 1 in which the mold sections have a second annular groove formed at their lower end and the tool has an annular flange received in said second groove, the annular flange being captured in the second annular groove when the mold is closed whereby the tool is prevented from moving until the mold sections are again separated at the completion of the shaping process.

6. The molding unit of claim 5 in which the preform also includes a bottom piece which is attached to the main body portion thereof by a double seam said tool structured such that the bottom double seam will overhang a side of the alignment tool, the inner surfaces of the mold sections having inwardly extending lower stepped recesses formed adjacent the bottom double seams so, the lower stepped recesses being structured to provide space between the mold sections and the bottom double seam such that the bottom double seam is not contacted by the mold sections during the shaping process.

7. The molding unit of claim 6 in which the lower recesses are stepped recesses that provide space between each double seam and the inner surfaces of the mold sections, the recesses extending above the height of each respective double seam such that the inner surfaces of the mold sections do not contact the respective double seam when the mold is closed.

8. The molding unit of claim 5 further including a groove formed in the head adjacent a shoulder of the top piece, an O-ring being received in the groove to seal off the outside of the preform from the air pressure inside the preform during the shaping operation, there being no pressure seal formed between the mold, when it is closed, and the atmosphere, so that there is no equalization of the pressure between the inside and outside of the preform during the shaping process.

* * * * *